United States Patent [19]

Larsen

[11] 4,235,386

[45] Nov. 25, 1980

[54] SHELL LINER ASSEMBLY FOR ORE GRINDING MILLS

[75] Inventor: Darrell R. Larsen, Salt Lake City, Utah

[73] Assignee: Minneapolis Electric Steel Castings Company, Minneapolis, Minn.

[21] Appl. No.: 932,711

[22] Filed: Aug. 11, 1978

[51] Int. Cl.[2] ..... B02C 17/22

[52] U.S. Cl. ..... 241/183; 241/182; 241/299

[58] Field of Search ..... 241/182, 183, 284, 299

[56] References Cited

U.S. PATENT DOCUMENTS

| | | | |
|---|---|---|---|
| 1,128,901 | 2/1915 | Posselt | 241/183 |
| 1,470,420 | 10/1923 | Askin et al. | 241/183 |
| 1,534,000 | 4/1925 | Baker | 241/183 |
| 1,872,036 | 8/1932 | Hardinge | 241/70 |
| 3,404,846 | 10/1968 | MacPherson et al. | 241/183 X |
| 3,462,090 | 8/1969 | Landes et al. | 241/299 |
| 3,582,007 | 6/1971 | Heighberger | 241/183 |
| 3,630,459 | 12/1971 | Slegten | 241/183 |
| 3,680,799 | 8/1972 | Hallerback | 241/183 |
| 3,804,346 | 4/1974 | Norman | 241/182 |
| 3,949,943 | 4/1976 | Schuler et al. | 241/183 |
| 4,018,393 | 4/1977 | Larsen | 241/182 |

FOREIGN PATENT DOCUMENTS

| | | |
|---|---|---|
| 1131489 | 10/1959 | Fed. Rep. of Germany . |
| 2305311 | 8/1974 | Fed. Rep. of Germany . |
| 47-4388 | 3/1967 | Japan . |

*Primary Examiner*—Richard B. Lazarus

*Attorney, Agent, or Firm*—Merchant, Gould, Smith, Edell, Welter & Schmidt

[57] ABSTRACT

The disclosure is directed to an improved liner assembly for an ore grinding mill. The liner assembly is of the segmented type, comprising a first plurality of segments which are mounted directly to the shell of the mill, and a second plurality of segments each of which is secured to an associated first segment independently of the shell. The first segments are formed from material which is resistant to impact, and the second segments are made from material which is highly resistant to abrasion. As constructed, the second segments can be replaced after a period of wear from inside the mill, avoiding the necessity of replacing the first liner segments which requires working teams both inside and outside the mill. In one embodiment, the second segments are L-shaped and are secured to the first segments by nut and bolt assemblies that are generally aligned with the shell surface to resist shear forces. In a second embodiment, the first and second segments resist shear forces with a tongue and groove configuration coupled with nut and bolt assemblies that are transverse to the shell surface.

18 Claims, 7 Drawing Figures

SHELL LINER ASSEMBLY FOR ORE GRINDING MILLS

The invention relates generally to apparatus for comminuting ore, and is specifically directed to an improved liner assembly for an ore grinding mill used in commercial mining operations.

Grinding mills of this type may employ rods or balls to assist in the comminuting process as the mill is rotated, or the ore may be self-grinding in large autogenous mills. An example of the latter type mill consists of a large cylindrical drum mounted on bearings for rotation about a substantially horizontal axis and driven by a powerful motor through conventional reduction gearing. The axial ends of the drum are open, and the material to be comminuted is continuously fed into the mill at one end with the comminuted product continuously emerging from the other end.

From the economic standpoint, it is important to keep any type of ore grinding mill in operation as continuously as possible, keeping the downtime for maintenance or repair to a minimum. However, many ores (e.g., taconite) are extremely hard and highly abrasive, and in order to maintain continuous operation of the grinding mill it is necessary to provide a liner for the drum which is highly abrasion resistant, and also tough enough to withstand the continuous impact of the ore fragments.

Due to size and weight considerations, liner assemblies for ore grinding mills of this type are typically segmented; i.e., they comprise a plurality of separate components that are individually secured to the drum or shell of the mill. My earlier U.S. Pat. No. 4,018,393 is directed to liner segments which are formed with sockets of a special shape and disposed at predetermined intervals, and which are held within the cylindrical shell by bolts having heads received in the sockets and threaded shanks passing through the liner segments and the mill shell to receive nuts at the outer surface. The sockets and heads are shaped to provide continuous flat contact areas of substantial size regardless of variations in center distances of holes axially along the shell.

This particular approach to securing the segment and liners to the shell has represented a significant improvement due to previous difficulties in obtaining registration of bolt holes in the segments and shell, and continuous flush engagement of contiguous surfaces. However, as was recognized in my later issued U.S. Pat. No. 4,046,326, the structural configuration of liner segments is necessarily complex, and does not lend itself to fabrication from materials which are highly abrasion resistant. Examples of ideal materials for this use are martensitic white iron or martensitic steel, both of which are extremely abrasion resistant. However, since materials such as these undergo a significant volume change as they pass from the austenitic stage to martensitic form, it is extremely difficult to form from such materials an article of significant size or complex configuration since the transformation from martensite, as the result of rapid cooling, may crack the article and render it useless in an ore crushing operation. Thus, prior to the invention disclosed and claimed in U.S. Pat. No. 4,046,326, segmented liners were usually made from a "tough" material which offered relatively good resistance to impact, although its resistance to abrasion was somewhat lower. My later patent was, therefore, directed to a liner assembly in which the primary structure of each liner segment is made from a "tough" material, coupled with the use of one or more inserts formed from highly abrasion resistant material in a manner such that the insert or inserts represent primary exposure to the ore fragments but are always retained, even if they break due to brittleness. This is accomplished through the formation of an opening extending entirely through the liner assembly, and which has tapered sides converging toward the exposed surface. The inserts are of conforming shape and size, having similar converging sides which engage and wedge against those of the segment opening. The inserts are placed into the segment opening from its back or unexposed side, projecting through to the exposed surface but being retained in this position by the wedging action. As the liner segment is bolted to the shell, the inserts are positively and rigidly retained, capable of comminuting the ore, but incapable of escape. With such an assembly, the inserts can be made in fairly simple configurations, to overcome the fabrication problem mentioned above, and thus enabling the benefits of abrasion resistant materials.

The use of hardened inserts substantially increases the life of the liner assembly, and as a result reduces the mill downtime encountered with previous liner assemblies that wore down more quickly and required changing more frequently. However, the changing of assemblies itself remains an arduous task, and a substantial number of man hours are required. This is due primarily to the manner of connecting the liner segments to the shell, which as described above, typically involves elongated bolts that pass entirely through each of the liner segments in the shell, with threaded nuts locking the segments from the outer shell surface. Accordingly, two teams of workers are required both in removing the worn liner assembly and in installing the new assembly, one team working within the drum and one outside. The problem is compounded by the substantial size and weight of each liner segment, and the damage to the segments and connecting bolts by the continuous impact of the ore fragments during the comminution process.

The subject process is thus directed to an improved liner assembly for ore grinding mills which is easily replaceable, while at the same time preserving the substantial benefit derived from the use of abrasion resistant inserts. More specifically, the improved assembly comprises a plurality of holder segments formed from tough, impact resistant material which are fastened directly to the shell in a conventional manner. The assembly further comprises a second plurality of liner segments formed from abrasion resistant material which "cap" the holder segment, and are uniquely connected directly thereto without any mounting connection to the shell itself. In both of the preferred embodiments, provision is made for protecting the fastening means from the ore fragments so that, even if the liner is substantially worn, there is less difficulty in removing the abrasion resistant caps.

In one embodiment, the abrasion resistant cap overlies the top of the holder, as well as the side exposed to the ore fragments as they tumble with rotation of the drum. The connector comprises a heavy bolt which is in substantial alignment with the shell surface. The head of the bolt is recessed within the abrasion resistant cap, and the locking nut is protected by a protective nose formed in the cap.

In an alternative embodiment, the entire abrasion resistant cap rests on the holder, and a tongue and groove relationship between the two resists shear forces imparted by the tumbling ore fragments. The cap fastener comprises a bolt disposed transversely of the drum surface, the head of which is recessed within the cap for protective purposes. A threaded insert captively held in a recess within the holder permits the connecting bolt to be drawn down tighty, clamping the components together.

DESCRIPTION OF THE PREFERRED EMBODIMENT

FIGS. 1–5 disclose a segmented liner assembly according to the invention and adopted for use with a cylindrical drum or shell 11 of an ore grinding machine. The ore grinding machine may be of the type disclosed in U.S. Pat. No. 4,046,326, in which the hollow cylindrical drum or shell 11 is constructed and arranged for rotation about a substantially horizontal axis. The drum or shell 11 is substantially closed by axial end walls with the exception of central axial openings through which the ore is respectively supplied and discharged.

Figure 3:
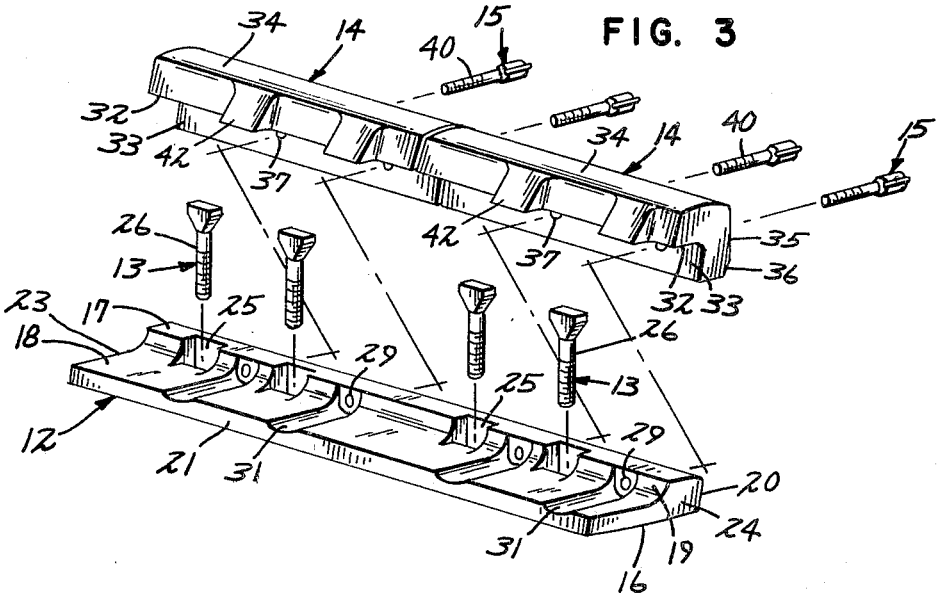
FIG. 3 is an exploded perspective view of the liner assembly components.
Figure 4:
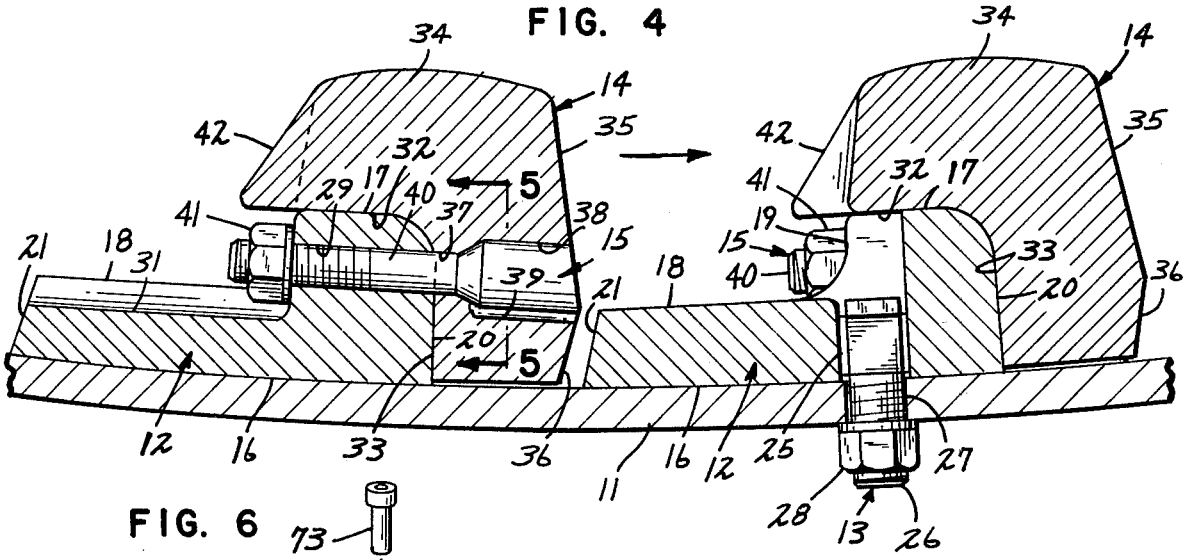
FIG. 4 is an enlarged fragmentary sectional view taken along the line 4—4 of FIG. 1.

With specific reference to FIG. 4, the liner assembly comprises a plurality of holder segments 12 fastened directly to the shell 11 by first fastening means 13, and a plurality of capped segments 14 which are secured only to the holder segments 12 by second fastening means 15. As shown in FIG. 3, both the holder segments 12 and cap segments 14 are elongated in shape, but in the preferred embodiment, two cap segments 14 are provided for each of the holder segments 12.

Figure 1:
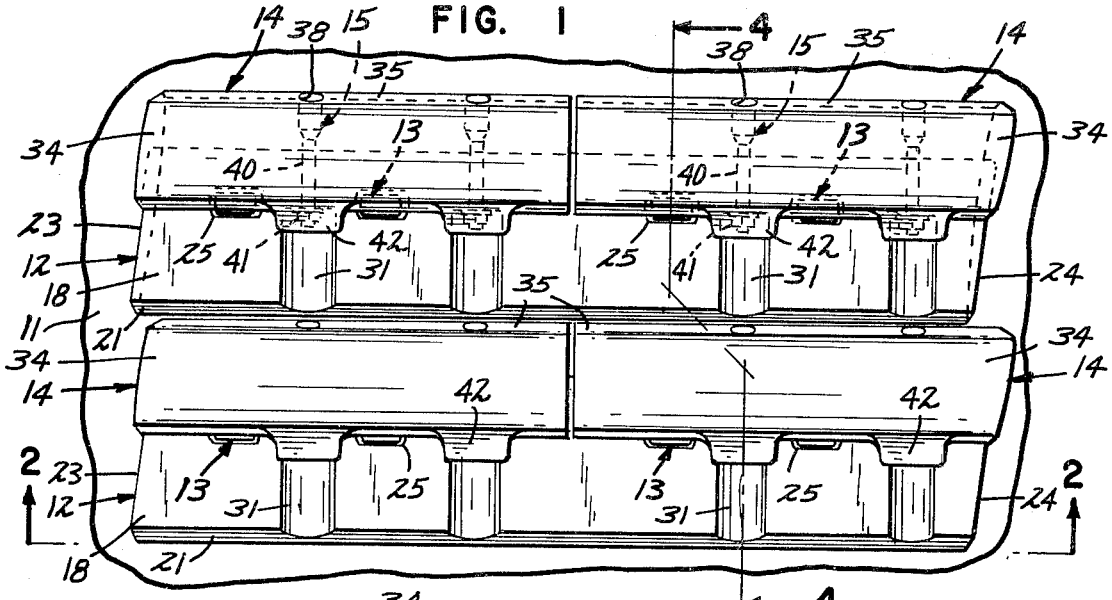
FIG. 1 is a fragmentary plan view of a segmented liner assembly for an ore grinding mill according to the invention, and viewed radially outward from within the mill.

As shown in FIG 1, the segments 12, 14 are arranged in a plurality of rows which are substantially parallel with the axis of rotation of the shell 11, the rows being disposed in close proximity to substantially cover the inner cylindrical surface of shell 11. The shell 11 is rotated in the direction indicated in FIG. 4, and since the segment and liner assembly is of irregular contour, the ore fragments are carried upward with rotation of the drum and then tumble downward in a comminuting manner.

With reference to FIG. 4, each of the holder segments 12 defines a slightly arcuate mounting surface 16 which conforms to the inner cylindrical surface of the shell 11. The top surface of each holder segment 12 is stepped, defining a flat upper surface 17 and a flat lower surface 18 interconnected by a transverse wall 19 that is rounded aat its juncture with each of the surfaces 17, 18.

Each of the holder segments 12 has a leading or forward edge 20 that is transverse to the surfaces 16, 17, and preferably substantially perpendicular thereto. The juncture of the surfaces 17 and 20 is rounded as shown. The surfaces 17, 20 together define a mounting surface for the holder segment 12, as will be discussed below.

Each holder segment 12 further defines a rear or trailing edge 21 which is slightly beveled for the purpose described below.

Figure 2:
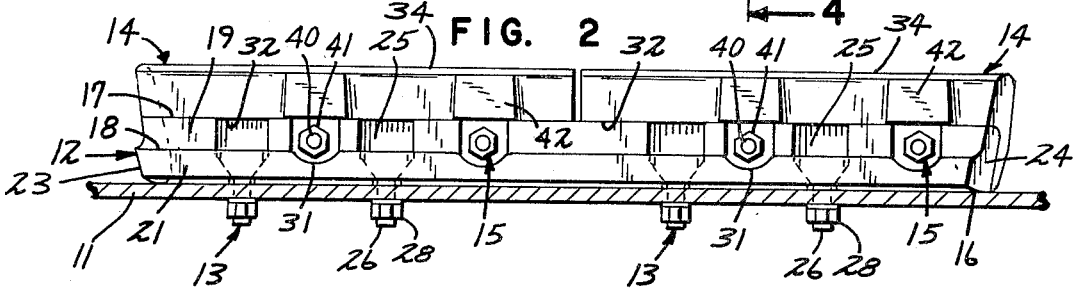
FIG. 2 is a fragmentary sectional view of the liner assembly taken along the line 2—2 of FIG. 1.

As shown in FIGS. 1 and 2, the holder segment 12 has sides 23, 24 which are angled from the leading edge 20 to the trailing edge 21, so that its overall configuration is generally trapezoidal. In addition, the sides 23, 24 converge slightly from top to bottom (i.e., toward the shell 11). This creates a recess with the side of an adjacent holder segment 12 which is generally wedge-shaped, with the larger base dimension of the recess located at the shell surface. This simplifies removal of the holder segment if necessary, even if the recess has become filled with solidified particulate matter. The side walls 23, 24, being inclined relative to such particulate matter, can be lifted out easily.

With reference to FIGS. 1–4, each of the holder segments 12 has a plurality of apertures 25 formed therethrough to receive the fastening means 13. As viewed in the top plan of FIG. 1, the apertures 25 are generally rectangular. As viewed in the side elevational view of FIG. 2, the apertures 25 define inclined side walls. As shown in FIGS. 3 and 4, the apertures 25 are formed through the upstanding portion of holder segment 12, and terminate at their upper end in a recess that opens laterally from the upstanding portion.

As constructed, the apertures 25 are adapted to receive the fastening means 13, each of which specifically comprises a threaded bolt 26 having a head with a first pair of opposed, tapered sides, and a second pair of flat, parallel sides. The apertures 25 can be disposed in registration with a like plurality of bores 27 formed through the shell 11. The threaded portion of the bolt 26 extends entirely through the aperture 25 and bore 27, and receives a locking nut 28 externally of the shell 11.

Reference is made to my earlier U.S. Pat. No. 4,018,393 for additional details of the structure and cooperative function of the apertures 25 and bolts 26. Each of the holder segments 12 is also formed with a plurality of bores 29 which extend entirely through the upstanding portion of the holder segment in substantially parallel relation with the surfaces 16–18.

As shown in FIGS. 1, 3 and 4, a plurality of shallow grooves 31 are formed in the lower step portion of holder segment 12, each of the grooves 31 extending in substantial alignment with and associated bore 29.

With specific reference to FIG. 4, each of the cap segments 14 is substantially L-shaped in transverse cross section, defining inner mounting surfaces 32, 33 which mateably conform to the surfaces 17, 20 of holder segment 12. Cap segment 14 further defines a top surface 34 which is slightly convex, and a leading surface 35 which is slightly beveled so that the ore fragments tend to tumble radially inward and not become lodged in the space between adjacent liner segments. However, the region of the leading surface immediately adjacent the inner shell surface is beveled in the opposite direction and shown at 36. As shown in FIG. 4, the angle of surface 36 is such that it diverges slightly from the adjacent trailing surface 21 of holder segment 12, thus creating a wedge-shaped cavity to facilitate segment removal as described above.

Each of the cap segments 14 has a bore 37 and counterbore 38 extending from the leading surfaces 35, 36 to the mounting surface 33. The bores 37, 38 are sized and disposed for registration with one of the bores 29 of a holder segment 12.

Figure 5:
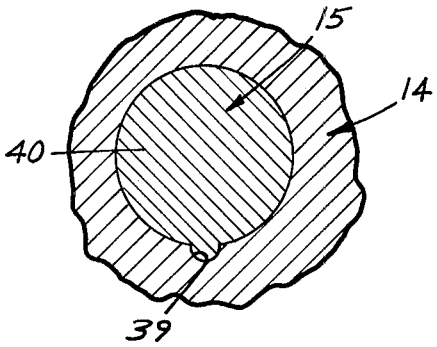
FIG. 5 is a further enlarged fragmentary sectional view taken along the line 5—5 of FIG. 4.

With references to FIGS. 4 and 5, an axially extending, semicircular groove 39 is formed adjacent the bores 37, 38 to accommodate the axial bead of a conventional "loon-head" bolt 40. Bolt 40 extends entirely through holder segment 12 and receives a locking nut 41, as best shown in FIG. 4. Because of the axial bead, the "loon-head" bolt 40 cannot rotate in the counterbore 38, enabling the cap segment 14 to be drawn tightly against the holder segment 12 by a single person with a single wrench.

With reference to FIGS. 3 and 4, cap segment 14 further comprises a "nose" 42 which protectively overlies the end of bolt 40 and nut 41.

In the preferred embodiment, the holder segments 12 are formed from tough, impact resistant material which is difficult to break and therefore capable of retaining the segments throughout their wearlife. The cap segments are preferably formed from material which is highly resistant to abrasion. Several materials are capable of use for both the holder segments and cap segments. Preferably, however, martensitic steel is used for both, which can be heat treated to be either tough and impact resistant, or highly resistant to abrasion. The procedures for obtaining these performance characteristics are well known in the metallurgical art. Another suitable example of an abrasion resistant material for the cap segments is martensitic white iron. Manganese steel may also be used as a tough material from which the holder segments may be formed.

As constructed, the holder segments 12 are initially installed with the use of fastening means 13. This task is carried out from both inside and outside the shell 11, but it is less frequently required. Next, the cap segments 14 are installed only from within the shell 11 with the fastening means 15. As assembled, and with the direction of rotation indicated in FIG. 4, the cap segments 14 are exposed to the ore to a much greater extent than the holder segments 12. Further, because of the construction and relationship of the components, the assembly resists shear stresses which are normally imposed during the comminution process. The orientation of bolts 40, which is substantially parallel with the inner drum surface, insures that the bolts are always in compression, which these axial members can withstand to a much greater degree than their resistance to shear forces.

When the cap segments 14 wear down to the point of requiring replacement, this can be accomplished from within the shell 11 and without removal of the holder segments 12. The nose member 42 assists in this regard by protecting the nuts 41, which are removed together with the "loon-head" bolts 40. New cap segments 14 can then be installed onto the existing holder segments 12.

Figure 6:
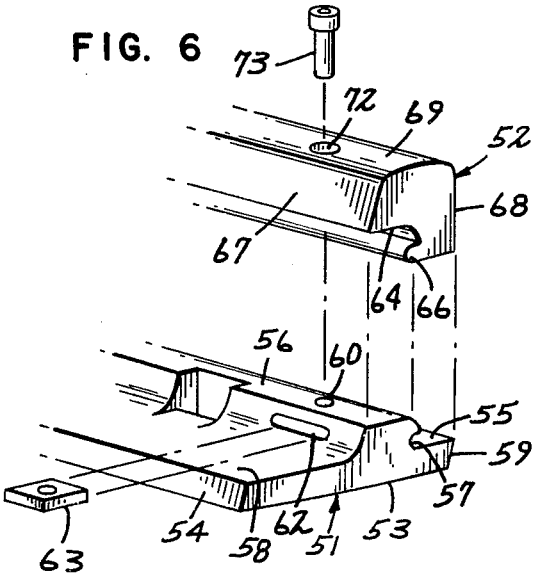
FIG. 6 is a fragmentary exploded perspective view similar to FIG. 3 of an alternative embodiment of the invention.
Figure 7:
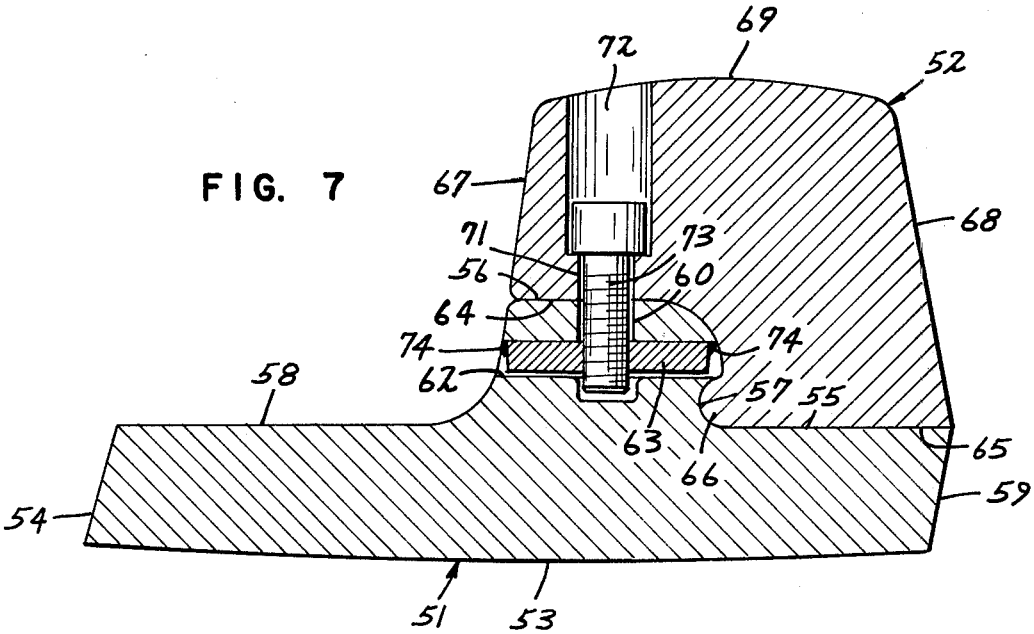
FIG. 7 is an enlarged transverse sectional view of the alternative liner assembly similar to FIG. 4.

FIGS. 6 and 7 disclose an alternative embodiment of the invention. The alternative assembly comprises a plurality of holder segments 51 and a plurality of cap segments 52. Each of the holder segments comprises a similar bottom mounting surface 53 and trailing side 54. However, the holder segments 51 support the cap segments 53 in their entirely, and accordingly include a lower stepped mounting surface 55 and a higher stepped mounting surface 56. Surfaces 55, 56 are interconnected by an irregular surface including a longitudinal groove 57.

Holder segment 51 further comprises a top surface 58 at substantially the same level of surface 55, but which does not support any part of the cap segment 53. A leading surface 59 for the holder segment 52 is similar in construction to the surface 36 of cap segment 14.

A plurality of blind bores 60 are formed through the upper mounting surface 56. A slot 62 traverses the bore 60 and is adapted to receive a square nut 63.

Each of the cap segments 52 is constructed to mateably conform to a holder segment 51. To this end, the cap segment 52 has a flat intermounting surface 64 conforming to the surface 56, a lower stepped surface 65 conforming to the surface 55, and an irregular connecting surface including a tongue 66 that fits into the groove 57.

The outer ore grinding surfaces of the cap segments 52 comprise diverging side surfaces 67, 68, interconnected by a top surface 69 which is slightly convex.

A perpendicular bore 71 and larger counterbore 72 extend through the cap segment 52 from the top surface 69 to the inner mounting surface 64. The bores 71, 72 are adapted to receive a socket head cap screw 73, which is sufficiently long to fit into the blind bore 60 for threadable engagement with the square nut 63.

Preferably, the square nut 63 is spot welded in place within the transverse slot 62, as indicated at 74. This is best accomplished by a preliminary assembly of the components, which insures proper registration of the nut 63 with the socket head screw 73 during later installation.

The tongue and groove configuration resists shear forces imposed on the assembly, and effectively insulates the cap screw 73 from such forces. The longitudinal tongue and groove also provide excellent retention and strength between the segments 51, 52 over their length.

The embodiment of FIGS. 6 and 7 offers the further advantage of using less metal in the cap segment, which wears away more quickly notwithstanding its abrasion resistance. This represents a considerable saving in material in view of the relatively frequent liner changes necessitated by worn components.

What is claimed is:

1. An improved liner assembly for the cylindrical shell of an ore grinding machine, comprising:

(a) a plurality of first liner segments of predetermined size and configuration, each defining a first mounting surface constructed for mounting engagement with the inner surface of the cylindrical shell, and each of said first liner segments defining a second mounting surface;

(b) a plurality of second liner segments of predetermined size and configuration, each defining a third mounting surface constructed to conform to the second mounting surface of a first liner segment, each of said second liner segments further defining a grinding surface for comminuting the ore;

(c) first connecting means for mounting each of said first liner segments directly to the cylindrical shell of the ore grinding machine independently of said second liner segments;

(d) and second connecting means for mounting each of said second liner segments to an associated one of said first liner segments independently of said cylindrical shell, said second connecting means constructed and arranged to permit removal of a second liner segment from the associated first liner segment without removing the associated first liner segments from the cylindrical shell.

2. The liner assembly defined by claim 1, wherein each of said second liner segments is formed from material that has a greater resistance to abrasion than the material of said first liner segments.

3. The liner assembly defined by claim 1, wherein each of said first liner segments is formed from material that has a greater resistance to impact than the material of said second liner segments.

4. The liner assembly defined by claim 1, wherein the second and third mounting surfaces are complementary.

5. The liner assembly defined by claim 4, wherein the second and third mounting surfaces comprise a first region substantially parallel with the first mounting surface and a second region substantially transverse thereto.

6. The liner assembly defined by claim 5, wherein the second connecting means comprises elongated bolt means extending through the first and second liner segments transversely of the second and third mounting surfaces.

7. The liner assembly defined by claim 6, wherein the second liner segment is substantially L-shaped in transverse cross section, defining a top and leading side that respectively overlie the top and leading side of the associated first liner segment.

8. The liner assembly defined by claim 7, wherein each of said bolt means comprises a threaded bolt and nut, the bolt having a head that is protectively recessed within the second liner segment, and said bolt projecting transversely of said second region through and beyond the first liner segment, the nut adapted to be drawn up against an externally accessible surface of the first liner segment.

9. The liner assembly defined by claim 7, wherein each of said second liner segments comprises a projecting nose member protectively overlying the nut.

10. The liner assembly defined by claim 5, wherein the complementary surfaces of said parallel region are substantially planar.

11. The liner assembly defined by claim 5, wherein the complementary surfaces of said transverse region are substantially planar.

12. The liner assembly defined by claim 5, wherein the complementary surfaces of said transverse region comprise a tongue and groove to resist shear forces imparted in a direction transverse thereto.

13. The liner assembly defined by claim 12, wherein the first liner segment comprises a laterally opening slot spaced from the first region of said second mounting surface, and the second connecting means comprises a bolt extending through the second liner segment and into the first liner segment beyond said slot, and a threaded nut for the bolt disposed in the slot.

14. The liner assembly defined by claim 13, wherein the bolt further comprises a head protectively recessed within the second liner segment.

15. The liner assembly defined by claim 13, wherein the nut is permanently secured within the slot.

16. The liner assembly defined by claim 1, wherein the second and third mounting surfaces are transversely disposed relative to the first mounting surface, and the second connecting means comprises elongated bolt means extending through said first and second liner segments and transversely of the second and third mounting surfaces.

17. The liner assembly defined by claim 1, wherein the second and third mounting surfaces are disposed in substantially parallel relation to the first mounting surface, and the second connecting means comprises elongated bolt means and extending through said first and second liner segments and transversely of the second and third mounting surfaces.

18. An improved liner assembly for the cylindrical shell of an ore grinding machine, comprising:

(a) a plurality of first liner segments of predetermined size and configuration, each defining a first mounting surface constructed for mounting engagement with the inner surface of the cylindrical shell, and each of said first liner segments including a plurality of mounting openings formed transversely therethrough;

(b) a plurality of second liner segments of predetermined size and configuration, each of said second liner segments defining a grinding surface for comminuting the ore;

(c) first connecting means comprising a plurality of mounting bolts extending through said mounting openings for mounting each of said first liner segments directly to the cylindrical shell of the ore grinding machine independently of said second liner segments;

(d) and second connecting means for mounting each of the second liner segments on an associated one of said first liner segments, said second connecting means constructed and arranged to permit removal of a second liner segment from the associated first liner segment without removing the associated first liner segment from the cylindrical shell;

(e) said first and second liner segments being so constructed that the second liner segments protectively cover the mounting openings and mounting bolts of the first liner segments with the liner assembly in assembled relation.

* * * * *